United States Patent [19]

Scheidemann et al.

[11] 4,395,750

[45] Jul. 26, 1983

[54] OPERATING ROOM LIGHT

[75] Inventors: Hans Scheidemann, Maintal; Alois Rieth, Offenbach; Bruno Sebralla, Bruchköbel; Walter Wohlfart, Klein Ostheim, all of Fed. Rep. of Germany

[73] Assignee: W. C. Heraeus GmbH, Hanau, Fed. Rep. of Germany

[21] Appl. No.: 231,159

[22] Filed: Feb. 3, 1981

[51] Int. Cl.[3] ..... F21V 1/00

[52] U.S. Cl. ..... 362/239; 362/285; 362/287; 362/298; 362/804

[58] Field of Search ..... 362/287, 285, 277, 281, 362/282, 283, 284, 239, 298, 238, 306, 427, 428, 804

[56] References Cited

U.S. PATENT DOCUMENTS

| | | | |
|---|---|---|---|
| 3,075,071 | 1/1963 | Lauterbach | 362/285 |
| 3,887,801 | 6/1975 | Ilzig et al. . | |
| 4,025,778 | 5/1977 | Hayakawa | 362/287 |
| 4,316,237 | 2/1982 | Yamada | 362/804 |

*Primary Examiner*—Donald P. Walsh

*Attorney, Agent, or Firm*—Frishauf, Holtz, Goodman & Woodward

[57] ABSTRACT

To permit adjustment and ready removal of a halogen lamp from an operating room light so that the halogen bulb (3) can be positioned with respect to a dome-shaped reflector (1) to control the light distribution therefrom while being readily removable for bulb replacement and cleaning, a pivot arm (5) is hinged at a circumferential point to the outer circumference of the reflector (1) and held in horizontally extended position across the reflector by a latch (16, 20; 18, 19, 19'; 21, 27). The other end of the latch is in engagement with a vertically positionable adjustment sleeve or rod (7) to adjust the position of the latch arm, and hence of the lamp bulb (3) with respect to the apex of the reflector (1) by pivoting of the pivot arm (5) about its pivot point (6) adjacent the circumference of the reflector. A plurality of such lamps may be combined in a common housing (H), and adjustment can be carried out conjointly, for example by a drive (11, 23) common to all the adjustment elements.

10 Claims, 7 Drawing Figures

OPERATING ROOM LIGHT

Reference to related patent assigned to the assignee of the present application: U.S. Pat. No. 3,887,801, ILZIG et al, June 3, 1975.

The present invention relates to an operating room light, and more particularly to an operating room light using halogen lamps mounted base-down in counter reflectors which direct light upwardly towards a dome-shaped main reflector for, in turn, directing the entire light from the lamp downwardly towards an operating area or surface.

BACKGROUND

Various types of operating room lights are known; use of halogen incandescent lamps has the advantage that the lamps emit intense light and are comparatively easy to focus. These lamps generate, however, concentrated intense heat and are best operated in a predetermined position, for example base-down. To adjust the position of the lamp with respect to the dome-shaped reflector, it is possible to adjust the position of the reflector within a holding structure relative to the lamp; this, however, still leaves a support structure for the lamp base extending transversely of the reflector, which makes replacement of the lamp, should it burn out, cumbersome, and interferes with cleaning and maintenance of the reflective surface of the dome-shaped reflector.

THE INVENTION

It is an object to provide an operating room light which may be operated with single or multiple halogen incandescent lamps, which permits easy adjustment of the positioning of the lamp and the reflector, respectively, while permitting ready access to the lamp and to the reflector for service, for example replacement of a lightbulb, or cleaning and maintenance.

Briefly, an adjustable element such as a screw-sleeve and an up-down movable lever coupled to the sleeve or the like, is provided and movable with respect to the dome-shaped reflector. A pivot arm retains the lamp and the counter reflector which is preferably provided at one end thereof, the pivot arm being coupled to the adjustment element to move therewith and, by pivoting, permits adjustment of the position of the lamp with respect to the reflector. The pivot arm is retained on a strut extending partway across the dome-shaped reflector, for example a strip of material set on edge to cast as little a shadow as possible which, in turn, may itself be pivoted to the reflector or to the operating room lamp housing. A latch coupling is included to release the pivot completely, permitting tilting or tipping of the lamp and its socket from the normal position to approximately horizontal position for example, to provide access to the lamp bulb for replacement and to the inside of the reflector for maintenance.

DRAWINGS

FIG. 1 is a highly schematic side view, partly in section or phantom, of an operating room light with an adjustment arrangement for a halogen lamp;

FIG. 1*a* is a fragmentary view of another adjustment arrangement;

Figures 1, 1A:
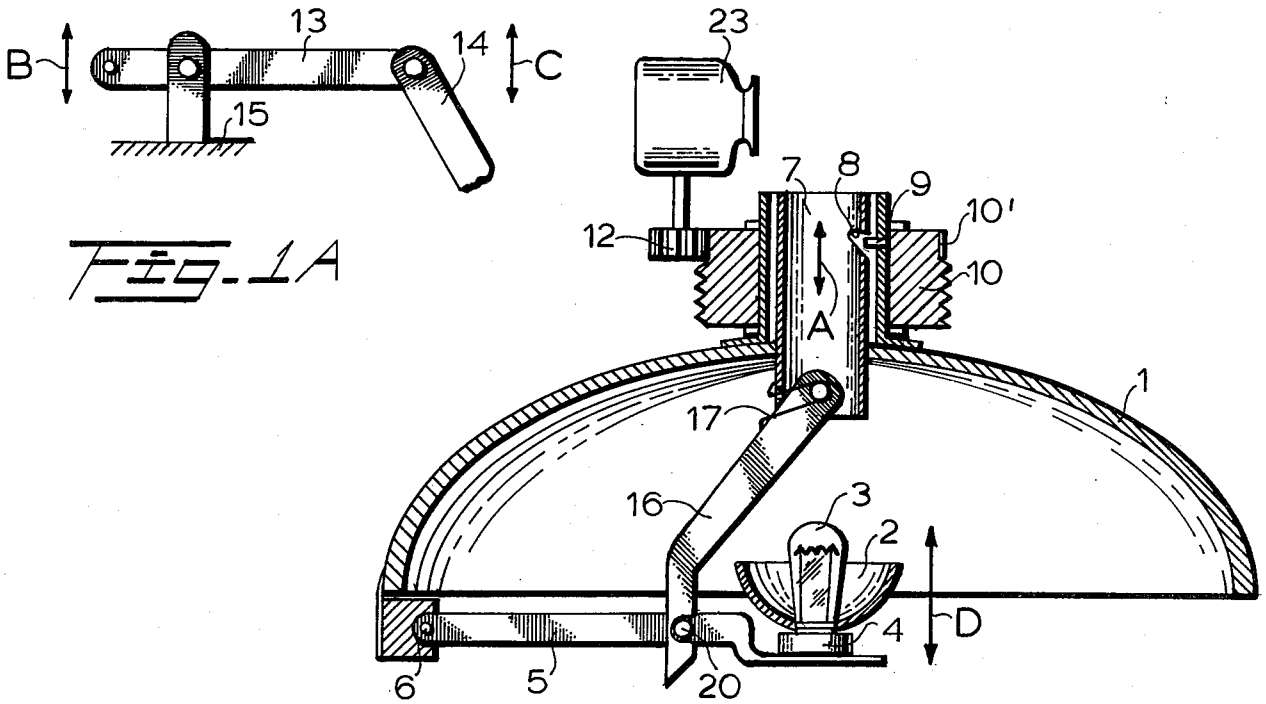

An operating room light as shown in FIG. 1 has a dome-shaped reflector 1 receiving light from a halogen incandescent lamp 3 which has its socket mounted in a fitting 4. Lamp 3 is surrounded by a counter reflector 2. The fitting 4 and the counter reflector 2 are securely connected together and, as shown in FIG. 1, positioned on a platform-like extension of a pivot arm or strut 5 which is pivoted at a point 6 at a fixed bracket attached to the dome-shaped reflector 1. The pivot point 6 is preferably secured to a bracket attached to the lower edge of the reflector 1, although it can be attached at different points, or to an outer lamp housing. The pivot arm 5 is coupled to an adjustment arrangement 7–10 to focus the lamp 3. The coupling is releasable. The pivot axis extends essentially tangentially with respect to the dome-shaped reflector 1.

The coupling which connects the lamp platform on which the fitting 4 is mounted includes a latch arm 16 having a notch which engages a bolt 20 extending from the pivot arm 5, and which is engaged in the latch arm 16. The latch arm 16 is maintained in the position shown in FIG. 1 by a spring 17. FIG. 1 illustrates the latch in locked position, that is, in the operating position of the lamp, which also permits focusing of the lamp 3 with respect to the reflector 1. The reflector is fixed; the bulb 3 is movable.

To adjust the focus point of the lamp 3 with respect to the reflector 1, a slotted sleeve 7 is moved vertically with respect to the apex of the dome 1 in the direction of the double arrow A. To effect such vertical movement, and hence focus the lamp 3 with respect to the reflector 1, or to change the field distribution of light from the reflector 1, the sleeve 7 is formed with an inclined slot 8 which is engaged by an internally extending pin 9. The pin 9 extends inwardly from a sleeve 10. Sleeve 10 has an outer gear 10' thereon which is coupled with a drive motor 23 through a pinion 12. Energization of the motor 23 in the selected direction will move the pin 9 with respect to the inclined slot 8, thus raising or lowering sleeve 7. The pin 9 and the slot 8, together, form a camming arrangement.

The slotted sleeve 7 can, if desired, be positioned manually—see FIG. 1*a*. Rather than using the rotary arrangement 8, 9, 10, 10', 12, 23, shown in FIG. 1, a direct coupling can be effected by a link 13 coupled to a lever 14 engaging sleeve 7. Link 13 is pivoted at a fixed point on the lamp, for example on a support strut 15 or the like. Movement of the link 13 in the direction of the arrow B, for example manually, will move the link 14 in the direction of the double arrow C which, by coupling through sleeve 7, will move the latch lever 16 and hence the lamp fitting 4 and hence the lamp 3 in the direction of the double arrow D.

For cleaning, lamp replacement, or other maintenance or service, the latch lever 16 is moved to the left counter the tension of spring 17, thus disengaging the cross pin or bolt 20 from the notch in the lever 16, permitting the pivot arm 5 to swing downwardly, placing lamp 3 in a horizontal position and removing the arm 5 from an obstructing position across the dome-shaped reflector 1. The bulb 3 can then be easily removed, and the interior of the reflector 1 becomes readily accessible. The extent of pivoting permitted by the pivot 6 can be about 90°, more or less.

Figure 2:
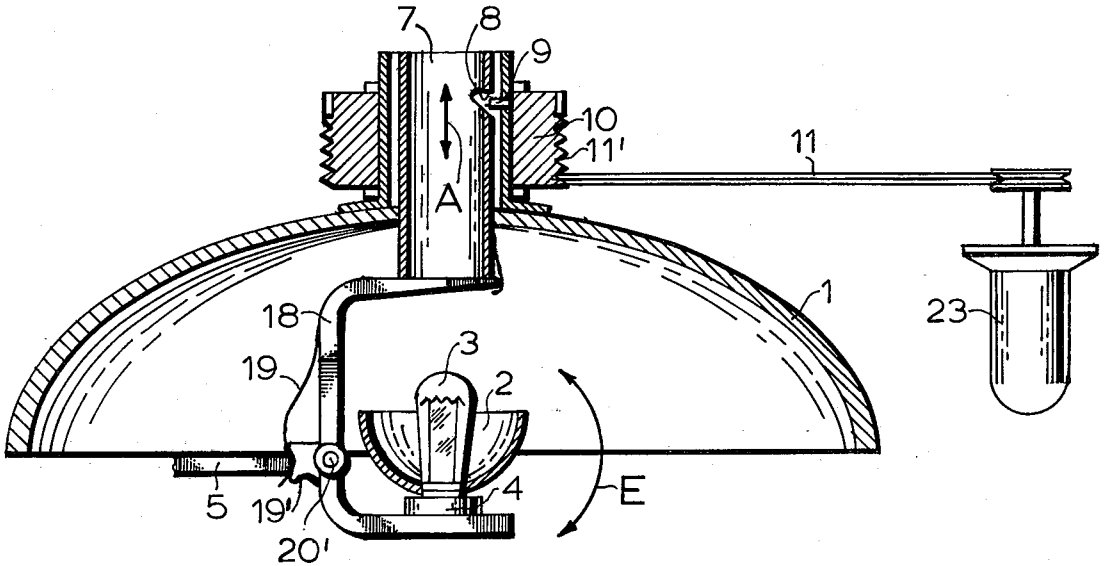
FIG. 2 is a view similar to FIG. 1, and showing another embodiment.

Embodiment of FIG. 2: Basically, the arrangement is the same except that the releasable coupling is placed on a double-armed lever 18 which is coupled to arm 5. Arm 5 may, again, be pivotably secured to the lamp housing such that its obstruction across the dome-shaped reflector 1 is negligible. A spring 19 is provided engaging with a bump or small undulation or corrugation into a similar projection 19' in the region of a pivot point 20' with which the double-armed lever 18 is pivoted about arm 5. The double-armed lever 18 has the fitting 4 for the lamp 3 and for the counter reflector 2 attached thereto. To replace bulb 3, the double-armed lever 18 is pivoted downwardly in the direction of the downward portion of the double arrow E, causing release of the corrugation of the spring 19 from the matching catch portion on arm 5 so that lamp 3 can be tilted into approximately horizontal position. Arm 18 is releasably attached to sleeve 7.

To adjust the relative vertical position of the lamp 3 with respect to the reflector 1, the sleeve 7 is moved in the direction of the double arrow A. The double-arrow lever 18 can be held in engagement with the sleeve 7 by a snap spring, can be attached thereto by fitting into a slot, or a spiral spring can be placed at the pivot point 6, holding arm 5 in upwardly biassed position.

FIG. 2 also shows an alternate arrangement to adjust the up-down position, arrow A, of sleeve 7. Motor 23 drives a pulley which is coupled to a belt 11, looped about a corrugated outer surface 11' of the outer rotatable nut 10. The return path of the belt 11 has been omitted for clarity. Energization of the motor 23, in either direction, will rotate the element 10, and engagement of the internally projecting pin 9 into the slot 8 will, again, move the sleeve 7 in the direction of the arrow A.

Figure 3:
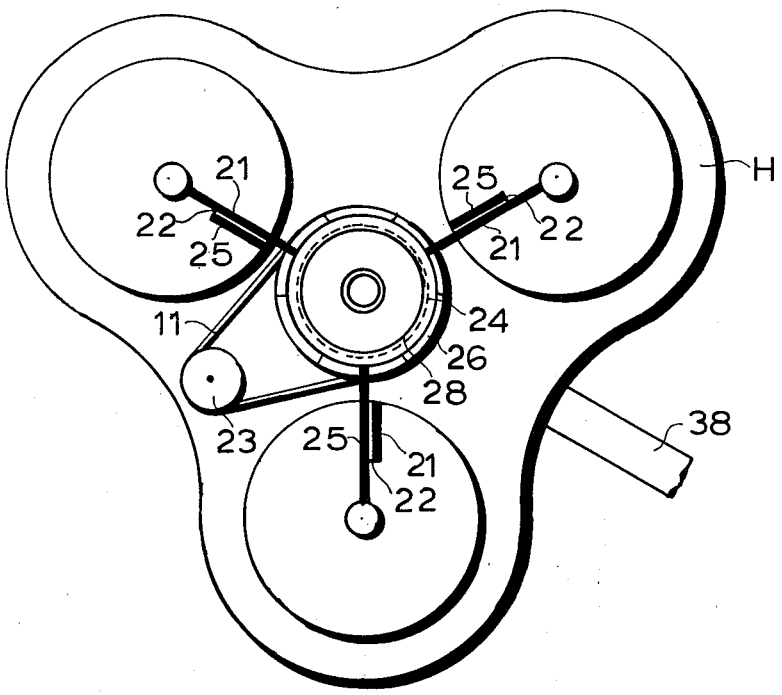
FIG. 3 is a bottom view in highly schematic form, and illustrating an operating room light with multiple light units.
Figure 4:
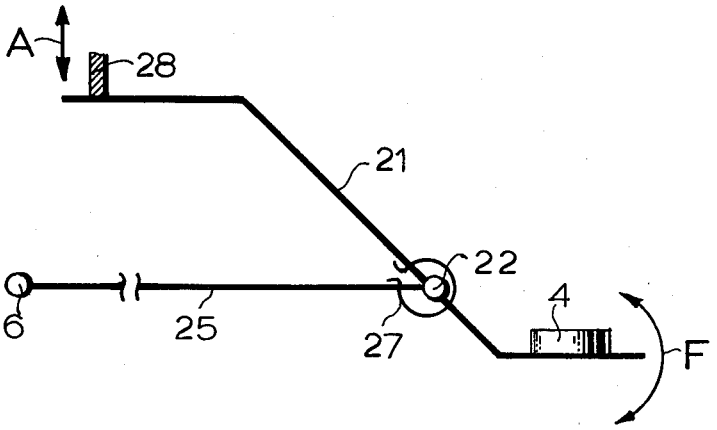
FIG. 4 is a highly schematic view of the holding arrangement for the incandescent bulbs of the lamp of FIG. 3.

A multiple lamp arrangement in a common housing can readily be constructed. For example, a plurality of units as shown in FIG. 1 can be included in a common holder H, and a common adjustment effected by looping a belt like belt 11 (FIG. 2) around outer corrugated surfaces 11' formed on the elements 10 of the respective units mounted on the holder or housing H. Thus, common adjustment of the reflection pattern from the bulbs 3 and the counter reflectors 2 of the respective units is possible, individual adjustment being effected by slipping the element 10 against the belt 11 in case the focal position of the filament of a specific bulb 3 should be out-of-alignment. FIG. 3 shows an alternative form in which a plurality of units similar to those shown in FIG. 2 are provided, three being shown within a common holder H, secured by a bracket or strap 38 to the ceiling of an operating room, for example. The double-armed lever holding the fitting 4 for the bulb 3 and the counter reflector 2 is slightly different, and shown in FIG. 4 in that it extends through a suitable opening formed in the dome-shaped reflector to a common or central sleeve 26 which corresponds, essentially, to the element 10 (FIGS. 1, 2) and which is circumferentially adjustable by motor 23 driving belt 11 looped thereabout. The sleeve 28 within sleeve 26, and constructed similarly to and corresponding to the vertically adjustable sleeve 7, is engaged by the upper portion of the double-armed lever 21 (see FIG. 4), maintained in engagement position by a spring 27. Arm 21 is pivoted about a pivot point 22 at the end of arm 25 which, similarly to arm 5 (FIG. 1), is attached to an edge portion, preferably the inner edge portion of the dome-shaped reflector or, alternatively, can be attached to a suitable attachment bracket or lug formed on the housing or holder H. As can be seen, movement of sleeve 28, upon rotation of motor 23 in the direction of the double arrow A (FIG. 4), will cause pivoting of arm 25 about pivot point 6, thus relatively positioning the fitting 4 with respect to the dome-shaped reflector (not shown) of the particular unit. The arm 21 can be released from engagement by release of the spring 27, for example, thus permitting arm 25 to tilt downwardly, and likewise permitting pivoting of the arm 21 about pivot 22 and placing fitting 4 in a convenient position for exchange of a bulb 3 therein (not shown).

Various modifications and changes may be made, and features described in connection with any one of the embodiments may be used with any of the others; for example, individual adjustment of the positions of the lamps in the arrangement of FIG. 3 is possible by using individual motors for the respective lamp units; or using adjustment by hand by moving sleeve 28 directly or with a linkage arrangement as shown in connection with FIG. 1*a*; or by other suitable means which may be externally accessible or automatically servo-controlled.

Figure 5:
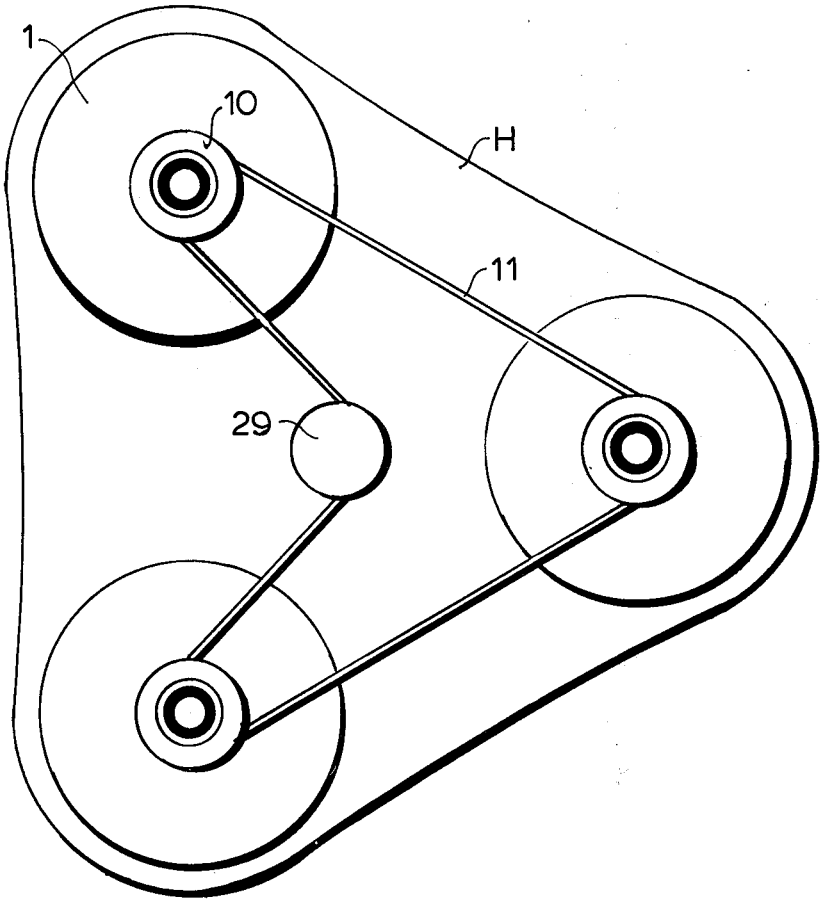
FIG. 5 is a bottom view in highly schematic form, and illustrating an operating room light with multiple light units with adjustment of the bulbs by hand or motor.

As shown in FIG. 5, a plurality of units as shown in FIG. 1 are included in a common holder H, and a common adjustment effected by looping a belt like belt 11 (FIG. 2) around outer corrugated surfaces formed on the elements 10 of the respective units mounted on the holder or housing H. The units are adjusted in synchronism by manual turning of the drive means 29, thereby moving the belt 11. Instead of the manual operated driving means 29 a motor driven means can be used.

Figure 6:
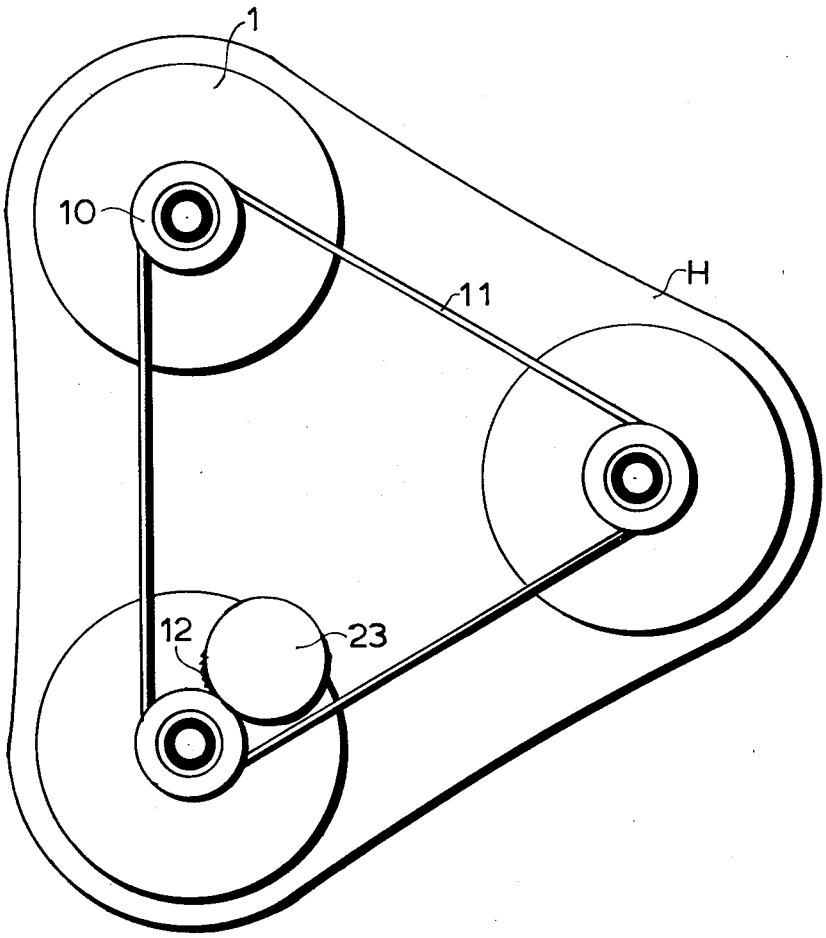
FIG. 6 is a bottom view of an operating room light as shown in FIG. 5, with a different driving arrangement.

The operating room light shown in FIG. 6 differs from the multiple unit operating room light of FIG. 5 in, that one of said multiple units is moved by a motor 23 through a pinion 12 (FIG. 1) and thereby moving also belt 11 causing a synchronous adjustment of the other units located in the holder H.

The light source is suitable for medical use, both as a single-bulb unit as well as a multiple-bulb unit, in which a plurality of combinations of reflector 1, counter reflector 2, and halogen lamp 3 are secured together in a holder H, symmetrically about its central axis, and commonly adjustable, by hand (FIG. 1*a*), or by a positioning motor (FIGS. 1, 2). The latch 16 as well as the double-armed lever 18 can be used and are securely connected, as shown in FIGS. 1 and 2, with the adjustment mechanism including the sleeve 7; sleeve 7 may be replaced by a solid bolt or the like. Thus, the halogen bulb 3 with its fitting 4 and the counter reflector 2 are effectively accurately positioned at the free end of the lever 5 and can move with respect to fixed reflector 1.

The referenced U.S. Pat. No. 3,887,801 illustrates an operating room lamp in which the light bulbs are "base up". The arrangement herein disclosed has the advantage of a releasable coupling and common adjustment for the lightbulb and its fitting in the direction of the optical axis, while additionally readily permitting replacement of the bulb and easy access to the reflector. Some lamp bulbs, for most efficient use, require "base down" operation, and the system as described is particularly applicable to this use.

We claim:

1. Operating room light haaving a dome-shaped reflector (1) formed with a downwardly directed light opening;

a halogen incandescent lamp bulb (3) positioned "base down" and directing light upwardly towards the dome-shaped reflector (1);

a counter reflector (2) surrounding the bulb and reflecting light upwardly towards the dome-shaped reflector (1);

and a holding structure for said bulb and counter reflector, comprising an arm (5) extending at least partly across the dome-shaped reflector, wherein said arm includes a fixed pivot point at one end thereof, located adjacent the circumference of the dome-shaped reflector, the halogen lamp bulb (3) being positioned adjacent the other end of said arm, and means positioning the pivot arm (5) and hence the bulb (3) with respect to the reflector comprising an adjustable element (7) capable of being adjustably positioned with respect to the apex of the dome-shaped reflector (1);

and a releasable coupling element (16, 20; 18, 19; 21, 22) connecting the pivot arm (5, 25) and the adjustable element (7, 28) to provide for pivotable adjustment of the pivot arm and hence the lamp bulb (3) with respect to the apex of the dome-shaped reflector upon positioning of the adjustable element and permit release of coupling engagement between the pivot arm and the adjustable element to permit free pivoting of the pivot arm about the pivot point adjacent the circumference of the reflector and hence repositioning of the bulb and the counter reflector to provide for accessibility to the bulb, the counter reflector and the dome-shaped reflector for servicing.

2. Operating room light according to claim 1, including spring means (17, 19, 27) maintaining said coupling element in connected position on the pivot arm.

3. Operating room light according to claim 1, wherein said fixed pivot point (6) pivoting said one end of the pivot arm (5) comprises a pivot bracket attached to the dome-shaped reflector at a circumferential point thereof, and forming a horizontal pivot axis extending essentially tangentially with respect to the circumference of the dome-shaped reflector (1).

4. Operating room light according to claim 1, wherein said releasable coupling element comprises a coupling lever (16, 18, 21); and spring-loaded engagement means (20; 19, 19', 27) coupling said coupling lever and said pivot arm (5) releasably together.

5. Operating room light according to claim 1, including a fitting (4) for the halogen lamp bulb (3), said fitting being affixed to the other end of said pivot arm (5);

and wherein said releasable coupling element comprises a latch lever (16) having a spring-loaded releasable engagement with the pivot arm and being secured to the adjustable element (7).

6. Operating room light according to claim 1, further including a fitting (4) for the halogen bulb (3);

a double-armed lever (18) having said fitting (4) affixed thereto at one end thereof, the other end of said double-armed lever being attached to said adjustable element (7);

and spring-loaded projection-and-recess means (19, 19') coupling the double-armed lever and said pivot arm (5) together.

7. Multiple unit operating room light assembly comprising a plurality of operating room lights as claimed in claim 1 wherein said adjustable element (7, 28) is common to all said operating room lights, said dome-shaped reflectors being secured within a holder (H);

and means adjusting the relative position of said adjustable element with respect to the holder to thereby adjust the relative position of the respective bulbs (3) with the respective dome-shaped reflectors (1).

8. Assembly according to claim 7, wherein the individual operating room lights are symmetrically positioned within the housing or holder (H) about a central axis thereof.

9. Operating room light according to claim 1, wherein the pivot axis of said pivot arm (5, 25) extends essentially tangentially with respect to the circumference of the dome-shaped reflector (1).

10. Operating room light according to claim 1, wherein the pivot axis of said pivot arm (5, 25) extends essentially transversely with respect to the longitudinal extent of the arm.

* * * * *